United States Patent [19]

Jaffin et al.

[11] 4,296,565

[45] Oct. 27, 1981

[54] APPARATUS FOR COLLECTING EJECTED CARTRIDGES

[76] Inventors: Harry A. Jaffin, 190 Parish St., Canandaigua, N.Y. 14424; Russell H. Gliewe, R.D. 3, Holcomb, N.Y. 14469

[21] Appl. No.: 84,555

[22] Filed: Oct. 15, 1979

[51] Int. Cl.[3] ..... F41C 27/00

[52] U.S. Cl. ..... 42/1 T; 232/1 R

[58] Field of Search ..... 42/1 T, 1 R, 90; 89/33 R; 232/1 R; 248/311.2, 311.3

[56] References Cited

U.S. PATENT DOCUMENTS 3,153,981 10/1964 Brass ..... 42/1 T 3,658,241 4/1972 Pistocchi ..... 89/33 F 4,110,927 9/1978 Morris ..... 42/1 T

*Primary Examiner*—Charles T. Jordan

*Attorney, Agent, or Firm*—Charles S. McGuire

[57] ABSTRACT

Apparatus for catching cartridges automatically ejected from a firearm without attaching or otherwise physically associating any structure with the firearms itself. A free-standing receptacle, comprising a resilient material having an open end supported in a vertical plane, is positioned laterally adjacent the firing position of the firearm such that the trajectory of the ejected cartridges carries them through the opening and into the receptacle. An arm supports the resilient material horizontally outward from the open end with sufficient slack to avoid rebounding of the cartridges out of the receptacle.

8 Claims, 3 Drawing Figures

APPARATUS FOR COLLECTING EJECTED CARTRIDGES

BACKGROUND OF THE INVENTION

The present invention relates to collecting or retrieving spent cartridges which are automatically ejected from firearms and, more particularly, to collecting empty cartridges as they are ejected from a firearm which is fired repeatedly from a relatively fixed position, as in target shooting.

It is desirable, for obvious economic reasons, to recover spent cartridges in order that they may be reloaded with a new bullet, powder and cap or primer. The brass cartridges ejected from pistols and rifles during target shooting are always collected following a firing exercise, usually by picking them up from the ground or floor. This inevitably involves searching for cartridges which may have bounced or rolled for some distance from the firing position, and may create a tendency on the part of the shooter to watch the cartridges as they are ejected. This distraction, of course, adversely affects concentration and therefore accuracy. There is also a safety factor involved in that shooters may be struck by hot brass ejected from nearby firearms.

Cartridge collecting receptacles, or other such means, have been provided in the past to insure that all spent cartridges will be caught and avoid the necessity of searching for and retrieving empty cartridges from the ground. To the best of our knowledge, however, all of the prior art cartridge collecting means have been attached to or somehow physically associated with the firearm. This in itself can cause a mental distraction, besides exerting an additional force on the firearm which is not normally present.

It is a principal object of the present invention to provide means for collecting spent cartridges from a firearm which is fired from a relatively fixed position wherein no structure is attached to or otherwise physically associated with the firearm.

A further object is to provide a free-standing receptacle for receiving cartridges automatically ejected from a firearm upon firing from a predetermined location laterally adjacent the receptacle.

Another object is to provide a free-standing cartridge collector having means for effectively preventing cartridges from rebounding or bouncing out of the receptacle upon being received therein.

Other objects will in part be obvious and will in part appear hereinafter.

SUMMARY OF THE INVENTION

In accordance with the foregoing objects, the invention contemplates a receptacle having an unobstructed opening which is positioned in a plane intersected by the trajectory of all cartridges ejected by a firearm when fired from a relatively fixed, predetermined position. The receptacle is preferably in the nature of a bag formed of a resilient material such as cloth or netting. The open end of the bag is supported by a rigid frame which orients the opening in a vertical plane which is positioned laterally adjacent the breech of the firearm when in the predetermined firing position.

The frame is supported upon a base and means may be provided for adjusting the vertical and/or horizontal position of the frame relative to the base. The netting, or other resilient material forming the bag-like receptacle, is supported horizontally with respect to the frame by one or more arms extending therefrom on the side opposite the position of the firearm. At least one of the arms engages an intermediate portion of the resilient material, as by passing through an opening therein, to provide slack in the portion of the material which is contacted by ejected cartridges, thus effectively preventing the cartridges from bouncing off the material and out of the receptacle.

DETAILED DESCRIPTION

Figure 1:
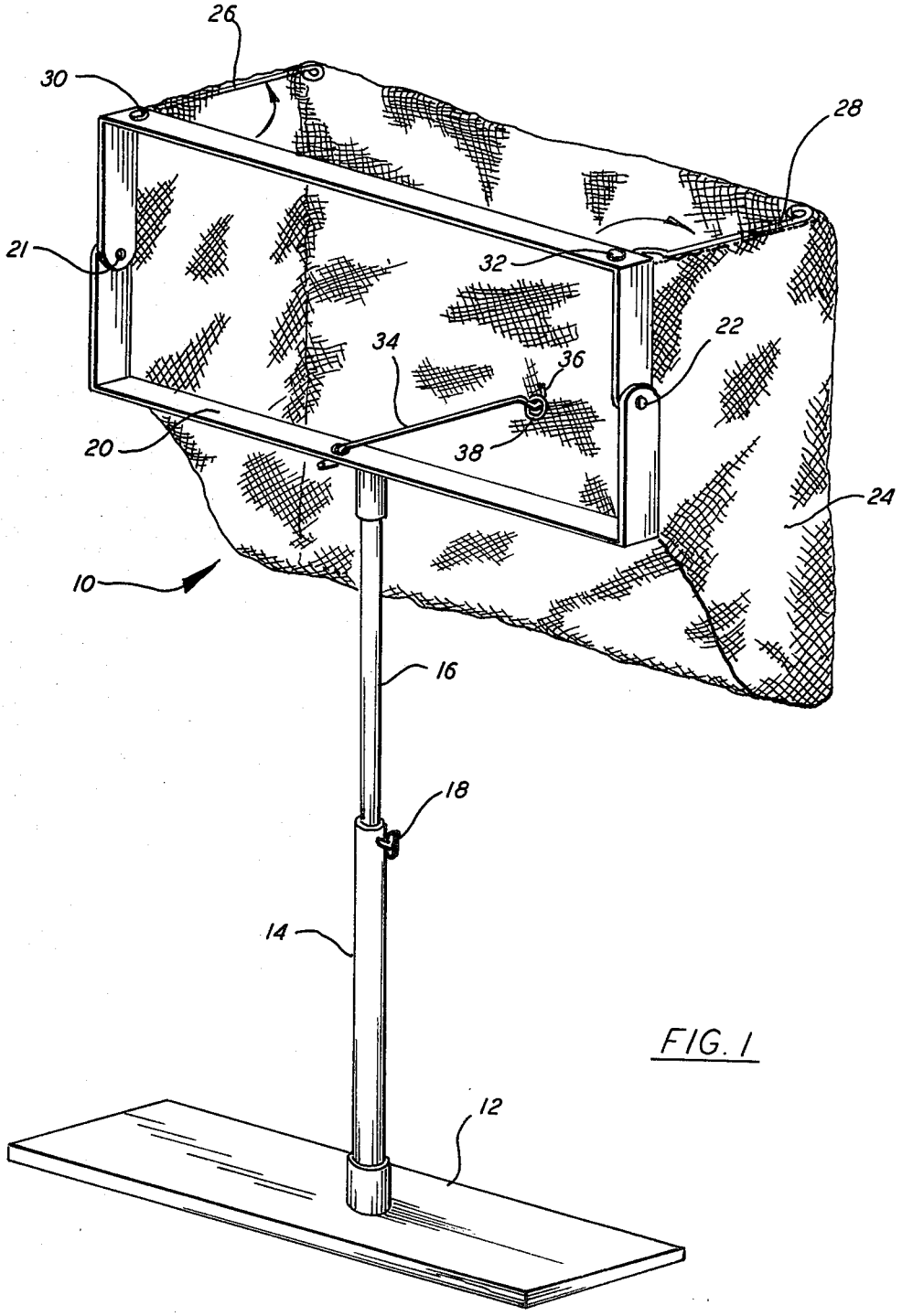
FIG. 1 is a perspective view of a preferred embodiment of the cartridge-receiving structure of the invention.

Referring now to the drawings, the reference numeral 10 denotes generally a free-standing structure for receiving spent cartridges ejected from a firearm which is positioned laterally adjacent to the receptacle when fired. Structure 10 includes base 12, which rests upon a support surface such as the ground or floor, or a shooting bench such as commonly provided at target shooting ranges. A vertical support rod extends from a fixed or releasable coupling with base 12 and, in the illustrated embodiment, is provided in two telescopically engaged sections 14 and 16, maintained in a desired relative position by set screw 18, or other locking device.

Rigid frame 20 is supported upon upper vertical support rod 16 with the opening defined by the frame in a substantially vertical plane. In the illustrated embodiment frame 20 is rectangular, being formed of two U-shaped sections attached by and movable about pivotal connections 21 and 22 for movement to a compact, folded position when not in use. It will be understood, of course that the invention also contemplates frames which are non-folding and configurations other than rectangular. The attachment of frame 20 to support rod 16 may be fixed or detachable, rigid or pivotable, and the same applies to the attachment of lower support rod 14 to base 12. If base 12 is intended to be permanently mounted, or attached to a shelf or shooter's bench by a clamp, or the like, a sliding attachment or other means of adjusting support rod 14 horizontally upon base 12 in order to place frame 20 in a desired position may be provided.

The cartridge-receiving receptacle is affixed, either permanently or detachably, to frame 20 about the periphery thereof to provide an unobstructed opening defined by the frame. The receptacle, denoted by reference numeral 24, is preferably formed of resilient material such as a woven or non-woven fabric (cloth, plastic, paper, etc.) in the form of a bag having its open end secured about frame 20. In order to minimize wind resistance, in applications where the invention is practised in outdoor shooting, receptacle 24 is preferably formed from an open mesh or net material having openings considerably smaller, of course, than the smallest cartridges with which it is to be employed.

Arms 26 and 28 are pivotally attached at 30 and 32, respectively, to frame 20 for movement, as indicated by the arrows, between folded and the illustrated extended positions. Arms 26 and 28 are positioned within receptacle 24 and, when in the extended position, serve to support the portion of the resilient material secured to the upper side of frame 20 horizontally outward with respect thereto. Arm 34 is likewise pivotally attached to the lower side of frame 20, and includes hooked end portion 36. Receptacle 24 is provided with a small opening, surrounded by reinforcing grommet 38.

The position of the opening with respect to the dimensions of arms 26, 28 and 34 is such that, with all three arms fully extended and hooked end portion 36 extending through the opening, as shown, there will be some amount of slack in the material between its supported positions on the ends of arms 26 and 28, and on arm 34. This may be best seen in FIG. 3, wherein the slack area is generally indicated by reference numeral 39. The purpose of providing slack in the material is to form a yieldable area in the portion of the material upon which ejected cartridges impinge as they are received in receptacle 24. If that portion of the receptacle, even though formed of resilient material, is rigid or taut there is a possibility that cartridges may bounce off the material and out of the receptacle rather than falling to the lower, closed end thereof as intended.

Figure 2:
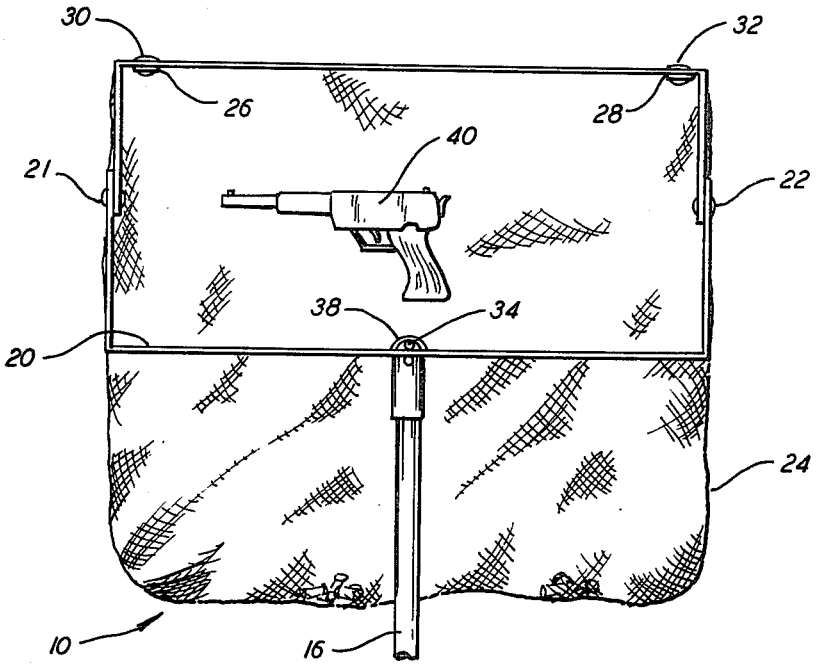
FIG. 2 is a side elevational view of the structure, showing a firearm positioned with respect thereto.
Figure 3:
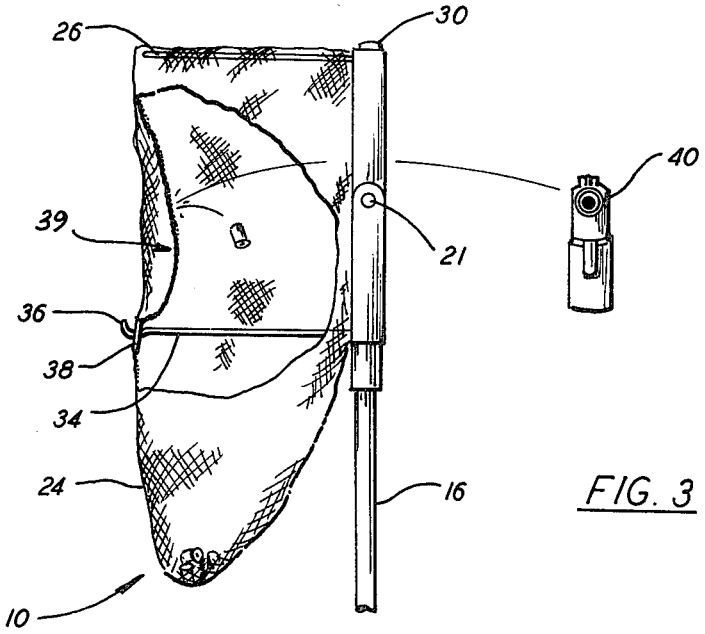
FIG. 3 is a front elevational view of the structure and firearm.

After determining the intended firing position of the firearm, shown in FIGS. 2 and 3 and denoted by reference numeral 40, structure 10 is positioned laterally adjacent such position with the opening defined by frame 20 occupying a plane which encompasses the entire area of trajectories of cartridges ejected from firearm 40. The boundaries of the plane, as defined by frame 20, will depend upon the lateral spacing between the frame and the breech of the firearm from which cartridges are ejected, as well as the ejection characteristics of the particular firearm being used. Thus, a small amount of trial and error may be necessary in positioning structure 10 properly the first time it is used with a given firearm. However, the amount of variation is not great and it will be found that positioning the structure with the approximate center of frame 20 about one foot laterally adjacent the ejection point of the spent cartridges will insure that all cartridges are received and retained in receptacle 24.

Thus, the invention provides an effective method, and a preferred structure for use in practising such method, for collecting 100% of all spent cartridges ejected from a properly operating firearm which is fired from a predetermined location relative to which the structure is positioned. The invention is particularly advantageous when employed in competitive target shooting since the structure quickly becomes a part of the natural visual environment, and effectively eliminates distractions such as watching the ejected cartridges, as well as the sight and feel of additional structure physically associated with the firearm. With such distractions removed, the shooter's concentration may improve, resulting in improved accuracy and score.

What is claimed is:

1. A free-standing structure for receiving cartridges automatically ejected from a firearm upon firing from a predetermined location, said structure comprising:

(a) wall means of flexible, resilient, unstretched material forming a bag-like enclosure with an unobstructed opening at one end;

(b) a rigid frame attached to said wall means and holding said one end of said wall means in a position laterally adjacent said predetermined location and physically separated from said firearm, with said opening fully occupying a plane intersected by cartridges ejected by said firearm when fired from said predetermined location, whereby said ejected cartridges pass through said opening and strike the interior of said bag-like enclosure; and (c) support means holding said wall means outwardly from said frame to provide a portion of said wall means directly opposite and spaced from said opening in a slack, unstretched condition to substantially prevent rebound of said cartridges.

2. The invention according to claim 1 wherein said wall means is formed of resilient material.

3. The invention according to claim 1 wherein said support means comprises:

(a) a base;

(b) a rigid frame surrounding said opening and to which said one end of said wall means is attached; and (c) means for supporting said frame relative to said base.

4. The invention according to claim 3 and further including means for adjusting the vertical position of said frame relative to said base.

5. The invention according to claims 3 or 4 wherein said frame is oriented to maintain the plane of said opening substantially vertical.

6. The invention according to claim 1 wherein said support means comprises at least one arm extending from said frame.

7. The invention according to claim 6 wherein said arm extends substantially horizontally from said frame and engages an intermediate portion of said wall means remote from said one end and maintains said intermediate portion in horizontally spaced relation to said frame.

8. The invention according to claim 7 wherein said arm maintains said intermediate portion in spaced relation to said frame with slack in said resilient material between all portions of said one end and said intermediate portion of said wall means.

* * * * *